United States Patent [19]

Yagi et al.

[11] Patent Number: 4,627,752

[45] Date of Patent: Dec. 9, 1986

[54] DAISY WHEEL PRINTING DEVICE WITH VARIABLE HAMMER DELAY

[75] Inventors: Norio Yagi, Shizuoka; Akira Nuita, Mishima, both of Japan

[73] Assignee: Tokyo Electric Co., Ltd., Tokyo, Japan

[21] Appl. No.: 656,456

[22] Filed: Oct. 1, 1984

[30] Foreign Application Priority Data

Oct. 7, 1983 [JP] Japan ..... 58-187935

[51] Int. Cl.[4] ..... B41J 1/30

[52] U.S. Cl. ..... 400/144.2

[58] Field of Search ..... 400/144.2, 51, 320

[56] References Cited

U.S. PATENT DOCUMENTS

| | | | |
|---|---|---|---|
| 4,030,591 | 6/1977 | Martin et al. | 400/51 |
| 4,189,246 | 2/1980 | Kane et al. | 400/51 |
| 4,353,020 | 10/1982 | Veale | 400/144.2 |
| 4,385,847 | 5/1983 | Avison | 400/144.2 |
| 4,493,570 | 1/1985 | Araki | 400/144.2 |
| 4,502,800 | 3/1985 | Jamieson et al. | 400/144.2 |

*Primary Examiner*—Edgar S. Burr
*Assistant Examiner*—David A. Wiecking
*Attorney, Agent, or Firm*—Frishauf, Holtz, Goodman & Woodward

[57] ABSTRACT

A daisy wheel type printing device comprises a daisy printing wheel including a plurality of type holding members having type at the respective ends thereof, wheel driving motor for rotating the daisy printing wheel to set the type designated by input character data to a printing position, a printing hammer for hitting the type set to the printing position, and a control circuit for driving the printing hammer when a preset a period of time has elapsed after the type designated by the input character data has arrived at the printing position. The preset period of time is varied in response to the rotation amount by which said daisy printing wheel is rotated to set the designated type at the printing position. The delay is larger for a wheel rotation of less than a predetermined amount than it is for a large rotation.

6 Claims, 9 Drawing Figures

FIG. 3
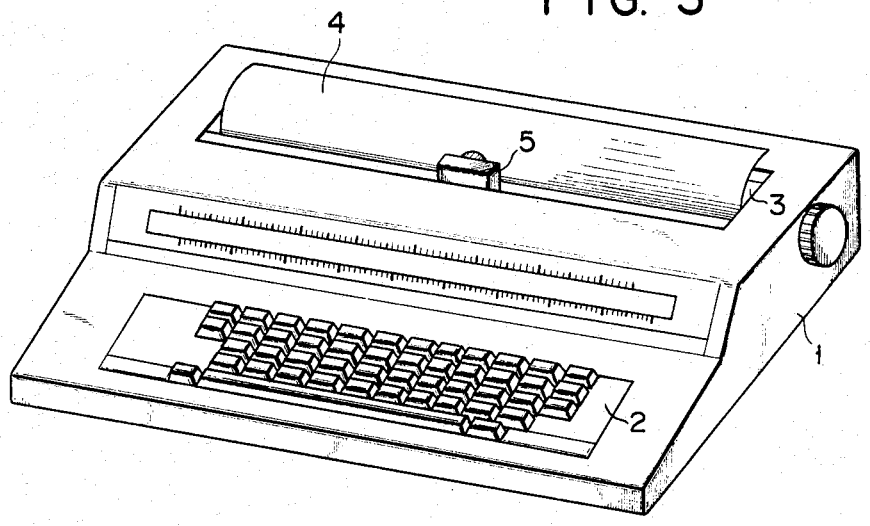
FIG. 5
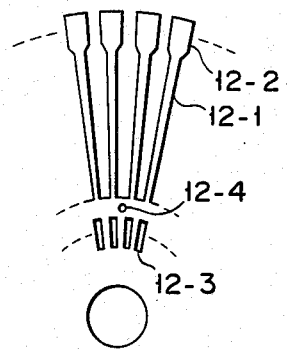
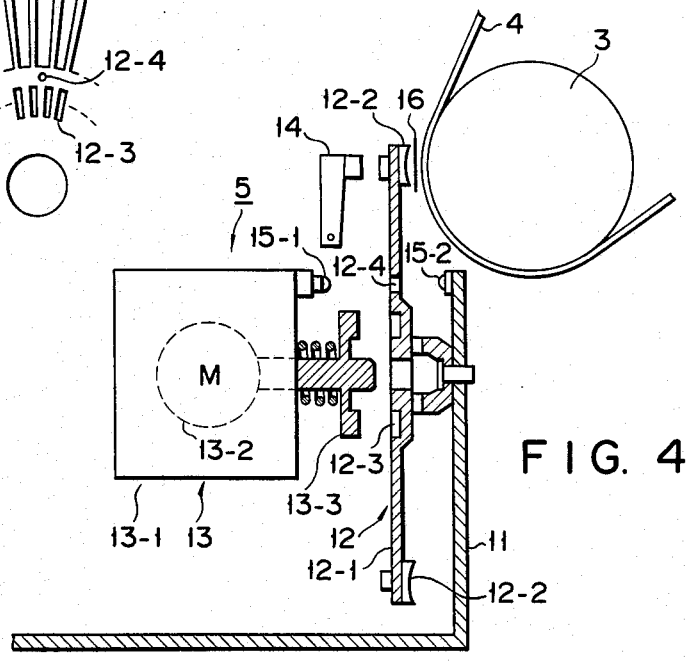
FIG. 4

DAISY WHEEL PRINTING DEVICE WITH VARIABLE HAMMER DELAY

BACKGROUND OF THE INVENTION

The present invention relates to a daisy wheel type printing device.

A daisy printing wheel is employed, for example, in the printing device associated with an electronic typewriter. The daisy printing wheel used in the printing device of this type is usually formed of a plurality of rectangular supporting plates arranged to extend radially from the center thereof. This printing wheel is arranged in a position facing a platen and driven by a stepping motor. When a character is to be printed, the printing wheel is rotatably driven by the stepping motor, the type of the character to be printed is set in the printing position facing the paper on the platen, and the type is then struck by a printing hammer driven by a solenoid coil, thereby printing the desired character on the paper through an ink ribbon.

Assuming that an angle formed between the adjacent two supporting plates of the daisy printing wheel is one pitch, one revolution of a printing wheel formed, for example, of 100 supporting plates corresponds to 100 pitches. It is, therefore, sometimes necessary to rotatably move the printing wheel from zero pitch (0°) to 50 pitches (180°) when a desired character is to be printed. In this case, in order to rotate the printing wheel to a position designated by the desired character to be printed as soon as possible, the printing wheel is rotated by a rotary speed pattern determined in advance in accordance with the rotation distance (or the the number of moving pitches) of the printing wheel. When this printing wheel has been completely driven to the designated position, a hunting type of vibration occurs at the supporting plates and type. Therefore, a quiescent time which is slightly longer than the longest time required for attenuating the vibration to a sufficiently small value is set. The printing wheel is driven after this quiescent time has elapsed after the printing wheel has arrived at the designated position. However, the vibration generated at the supporting plates and type of the printing wheel might be attenuated to a sufficiently small value within a time that is much shorter than the preset quiescent time when the printing wheel is driven to a designated position in accordance with a predetermined speed pattern. Even in this case, the printing hammer is not driven until the quiescent time has elapsed, and the average printing speed is accordingly lowered.

SUMMARY OF THE INVENTION

An object of the present invention is to provide a daisy wheel type printing device which can enhance the printing speed of a daisy printing wheel by varying the period from the time when the printing wheel arrives at a designated position to the time when a printing hammer is driven in response to the number of pitches of the printing wheel.

In order to achieve the above and other objects, there is provided, according to the present invention, a daisy wheel type printing device comprising a daisy printing wheel having a plurality of type holding members having type at their respective ends, a drive unit for rotating the daisy printing wheel to set the type designated by input character data to a printing position, a printing hammer for hitting the type set in the printing position, and a control unit for driving the printing hammer after a period of time selectively set in accordance with the rotation amount of the daisy printing wheel has elapsed after the type designated by the input character data arrived at the printing position.

In the present invention, when the rotation amount of the daisy printing wheel is large and the attenuating time of the vibration of the type is short, its standby or quiescent time is set to be short. However, when the rotation amount of the printing wheel is small and the attenuating time of the vibration of the type is long, its standby time is set to be long, and the printing hammer is driven after the standby time has elapsed. Therefore, the type can always be printed after its vibration has been effectively attenuated, and the average printing speed can be improved.

BRIEF DESCRIPTION OF THE DRAWINGS

FIG. 3 is a perspective view of an electronic typewriter provided with a printing device according to an embodiment of the present invention;

FIG. 4 is a partial sectional view of the printing device shown in FIG. 3;

FIG. 5 is a partial front view of the daisy printing wheel used in the printing device shown in FIG. 4;

DETAILED DESCRIPTION OF THE PREFERRED EMBODIMENTS

Figure 1:
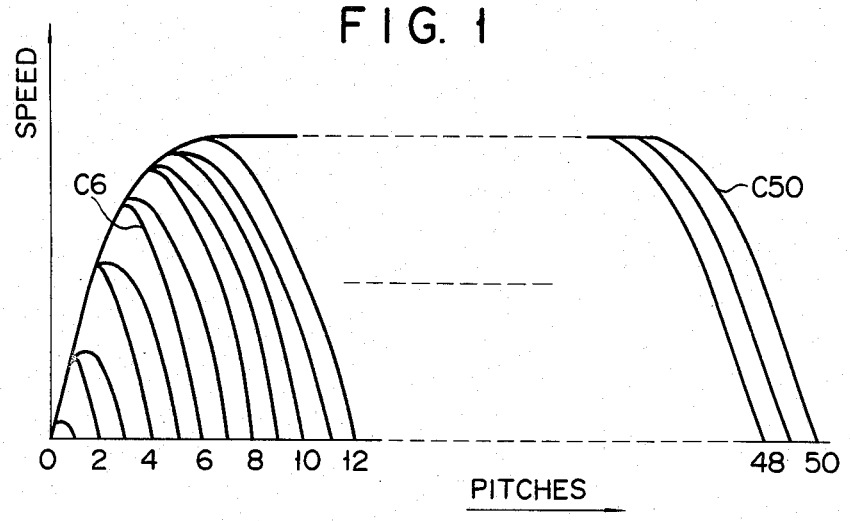
FIG. 1 is a rotation speed pattern diagram of a daisy printing wheel used in a printing device.

FIG. 1 shows a schematic speed pattern of a daisy printing wheel that can be moved from 1 to 50 pitches. When this printing wheel has moved, for example, 50 pitches, the printing wheel itself is rotated along with a speed pattern C50 as shown in FIG. 1. In other words, the printing wheel is rotated while being abruptly accelerated by increasing an exciting current flowing through an exciting coil of a stepping motor from an initial position to a sixth pitch position, and then is rotated at a predetermined speed, and is rotated to the fiftieth pitch position while being decelerated when the remaining pitch, for example, becomes six. The speed pattern of the printing wheel that has moved more than 13 pitches is substantially similar to the speed pattern C50 except that the period of constant-speed revolution is different.

When the daisy printing wheel is moved to six pitches, the printing wheel is rotated along with the speed pattern C6 shown in FIG. 1. In other words, the printing wheel is rotated while being abruptly accelerated from the initial position to the third pitch position, and is then rotated from the third pitch position to the sixth pitch position while being decelerated.

Figure 2A:
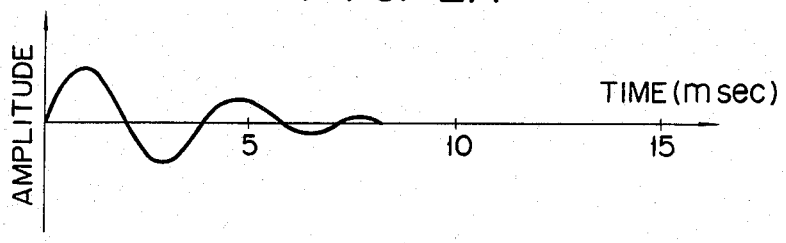
FIGS. 2A and 2B are attenuating characteristic diagrams of the vibration occurring in type after the daisy printing wheel has rotated at an angle either larger or smaller than a predetermined value.
Figure 2B:
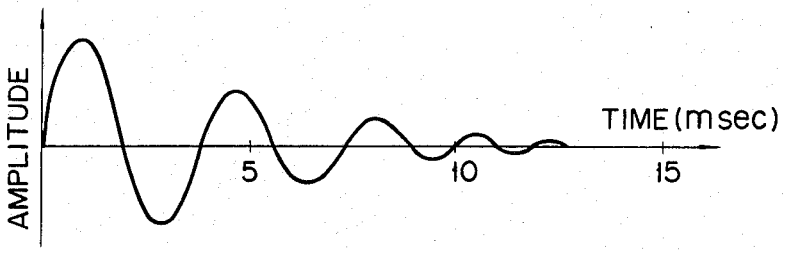

As described above, the daisy printing wheel arrives at the designated position, and a printing hammer is driven when the vibration of the supporting plates and of the type becomes sufficiently small. The vibration of the supporting plates and the type when the printing wheel is moved, for example, to the sixth pitch position is different from that when the wheel is moved to the 50th pitch position. For example, when the printing wheel is rotated to the 50th pitch position, the wheel is rotated at a constant speed from the sixth pitch position to the 44th pitch position, and is rotated from the 44th pitch position to the 50th pitch position while being decelerated. Thus, when the printing wheel is completely driven through 50 pitches, the vibration occurring at the supporting plates and at the type has a small value as shown in FIG. 2A, and is attenuated to have a sufficiently small value in as short as approximately 8 msec. When the printing wheel is moved through six pitches, the wheel is rotated from the initial position to the third pitch position while being abruptly accelerated and rotated from the third pitch position to the sixth pitch position where it is immediately decelerated. Thus, when the printing wheel is driven completely through six pitches, the vibration of the supporting plates and the type becomes large as shown in FIG. 2B, and can take as long as approximately 13 msec. until the vibration is attenuated to have a sufficiently small value.

Since a printing hammer is driven after a predetermined standby time has elapsed after a daisy printing wheel has been completely driven to the designated position in the conventional printing device, it is necessary to set the predetermined standby time to be longer than the longest attenuating time of the vibration, such as 15 msec. However, the printing wheel is not driven until 15 msec. has elapsed even though the vibration of the supporting plates and the type has been attenuated to have a sufficiently small value upon the lapse of the approximately 8 msec. in a case where the printing wheel is driven at through 50 pitches. Thus, the average printing speed is lowered.

FIG. 3 shows an electronic typewriter using a daisy wheel type printing device, according to one embodiment of the present invention, whose average printing speed has been improved. This typewriter has a housing 1 and a keyboard 2 provided at the front of the housing 1. In the keyboard 2 are arranged character keys, a space key, a carriage return key, a shift key, right and left margin keys, a tab set key and the like. A platen 3 is rotatably provided at the upper rear part of the housing 1 to hold a sheet 4. A printing device 5 carried on a carriage (not shown) is provided opposite the platen 3. This printing device prints the character corresponding to the character key operated by the known method on the sheet 4 set on the platen 3.

The printing device 5 comprises, as shown in FIG. 4, a frame 11 fixedly secured to a carriage (not shown), a daisy printing wheel 12 rotatably mounted on the frame 11, a driver 13 for rotating the printing wheel 12, and a printing hammer 14.

The daisy printing wheel 12 has, as shown in FIG. 5, a plurality of rectangular supporting plates 12-1 which extend radially from the center thereof, a plurality of type 12-2 mounted at the ends of the respective supporting plates 12-1, a plurality of recesses 12-3 formed within the circumference of the plates 12-1, and through holes 12-4 for indicating the home position.

The driver 13 has a housing 13-1 which contains a stepping motor 13-2, and a coupler 13-3 which transmits the rotation of the motor 13-2 to the daisy printing wheel 12. The coupler 13-3 is formed to have projections which engage with the recesses 12-3 of the printing wheel 12 to transmit the rotation of the motor 13-2. A light source 15-1 is mounted on the housing 13-1. This light source 15-1 cooperates with a phototransistor 15-2 mounted on the frame 11 opposite the light source 15-1 to form a home position detector for detecting the through hole 12-4. One of the type 12-2 in the printing position faces the paper 4 on the platen 3 through a ribbon 16.

Figure 6:
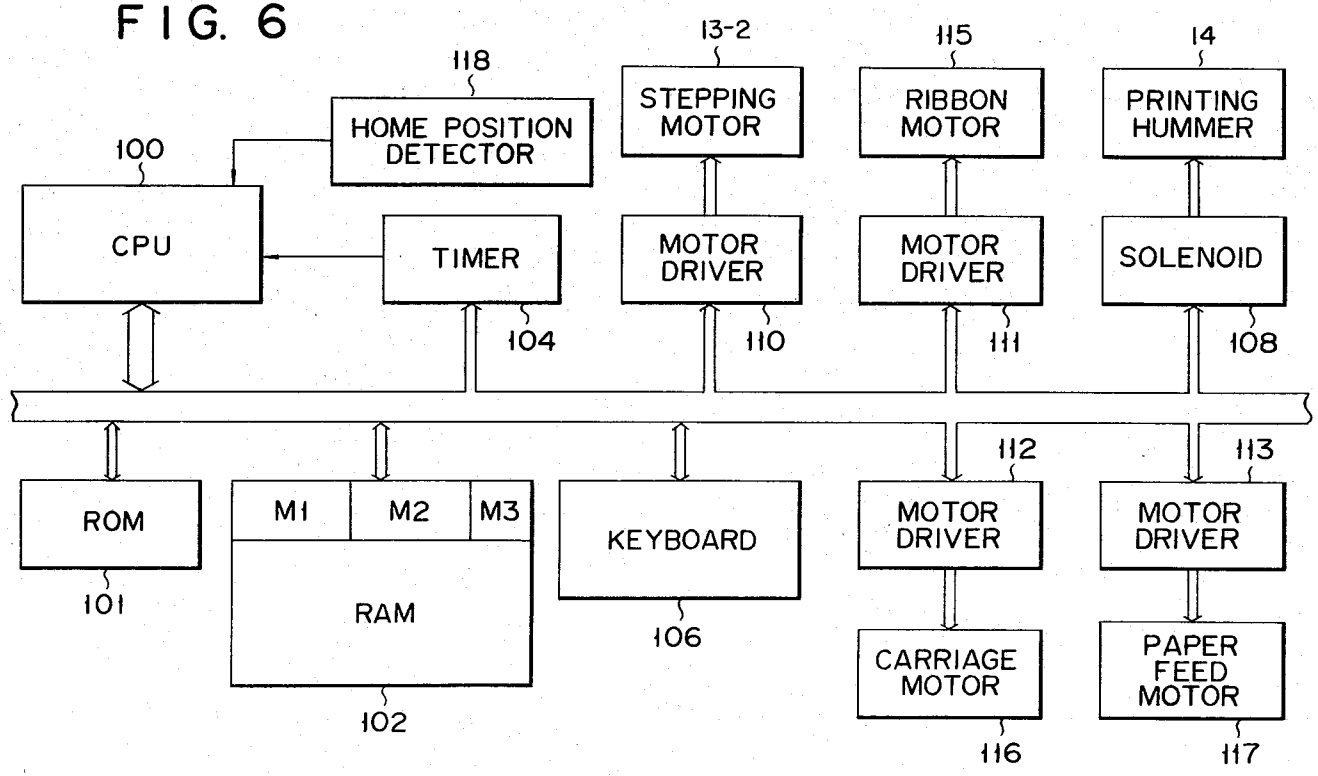
FIG. 6 is a block diagram of a control circuit of an electronic typewriter shown in FIG. 3.

FIG. 6 is a block diagram of a control circuit of an electronic typewriter shown in FIG. 4. This control circuit has a central processing unit (CPU) 100, a read only memory (ROM) for storing a program to be executed by the CPU 100, and a random access memory (RAM) 102 for storing data processed by the CPU 100. To the CPU 100 are coupled a timer 104, a keyboard 106 and a solenoid 108 for driving a printing hammer 14 through a data bus. Further, to the CPU 100 are connected a stepping motor 13-2, a carriage motor 116 and a paper feed motor 117 through motor drivers 110 to 113. Incidentally, a home position detector 118 is composed of the light source 15-1 and the phototransistor 15-2 as shown in FIG. 4, and generates an output signal when detecting that the printing wheel 12 is set in the home position.

Figure 7:
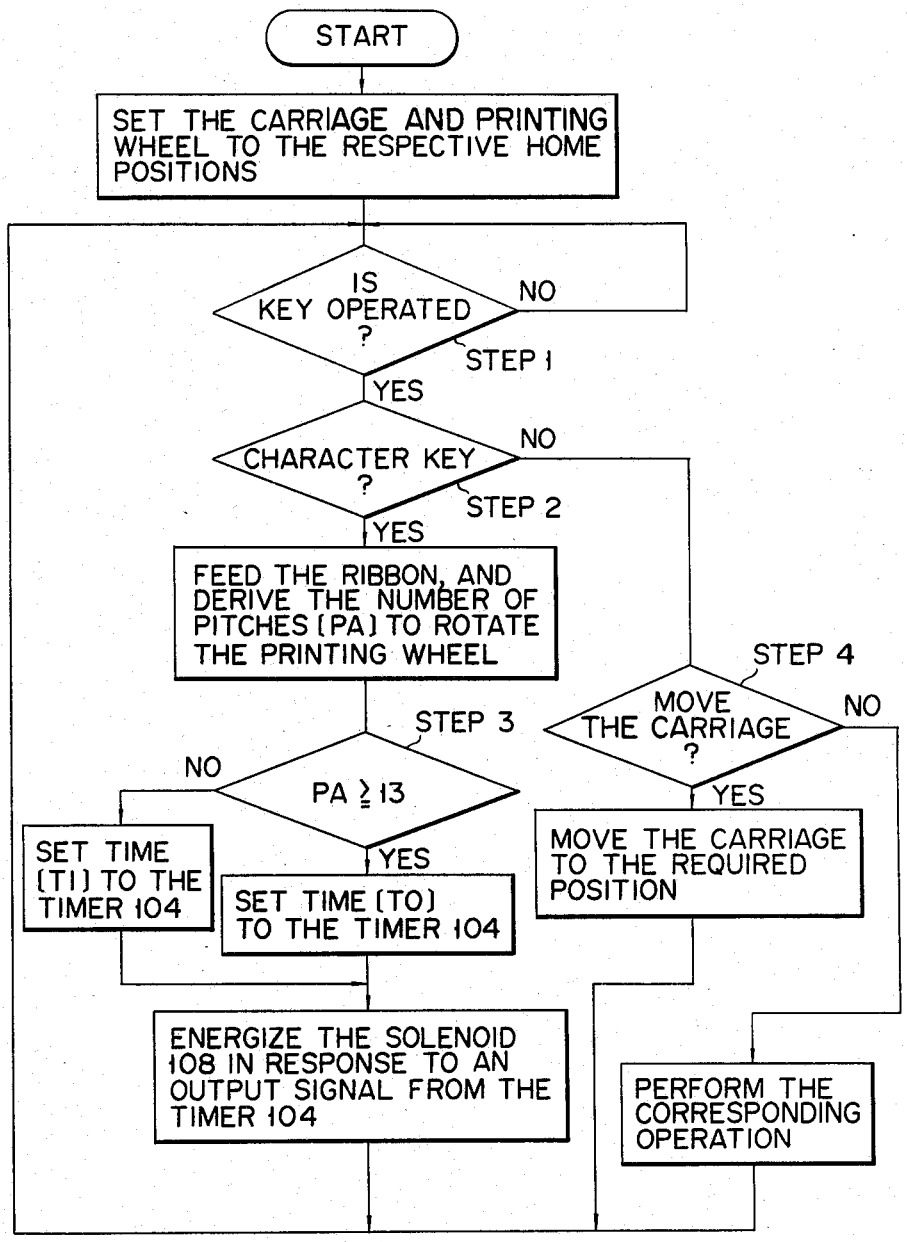
FIG. 7 is a flow chart showing the operation of the control circuit shown in FIG. 6.

The operation of the electronic typewriter will now be described with reference to the flow chart shown in FIG. 7. When a power source is energized, the CPU 100 applies a drive command signal to the motor drivers 110 and 112 to rotate the stepping motor 13-2 and the carriage motor 116. The CPU 100 stops the carriage motor 116 upon detecting that the carriage has moved to the leftmost home position to set the carriage at the home position and to stop the stepping motor 13-2 in response to an output signal from the home position detector 118, thereby setting the daisy printing wheel 12 to the home position. At this time, the CPU 100 writes the pitch position data (0) in the memory area Ml of the RAM 102.

Subsequently, the CPU 100 checks whether a key has been operated or not as in STEP 1. When the keying operation is detected, the CPU 100 checks to see whether or not the operated key is a character key as in STEP 2. When the operation of the character key is detected in STEP 2, the CPU 100 applies a drive command signal to the motor driver 111 to rotate the ribbon feed motor 115 by one step, thereby feeding an ink ribbon 16 at a predetermined distance. At this time, the CPU 100 calculates the number of pitches (PA) between the pitch position of the type designated by the character key thus operated and the pitch position represented by the pitch position data stored in the memory area M1, stores the number of pitches (PA) in the memory area M2, and stores data relating to direction to rotate the daisy printing wheel 12 in M3. Further, at this time, the CPU 100 stores the pitch position data of the type designated by the operated character key in the memory area M1. Next, the CPU 100 drives the carriage motor 116 through the motor driver 112 and supplies a drive command signal responsive to the directional data stored in the memory area M3 and to the number of pitches stored in the memory area M2 to the motor driver 110 while moving the carriage by one step, thereby rotating the stepping motor 13-2 by the number of corresponding steps in the designated direction. In this manner, the type designated by the operated character key is set at the printing position, i.e., at the position opposite the printing hammer 14. When the daisy printing wheel 12 has arrived at the designated position, i.e., when the type designated by the operated character key is set to the printing position, the CPU 100 checks if the number of pitches (PA) stored in the memory area M2 is smaller than 13 as in STEP 3. When it is detected that the number of pitches (PA) is 13 or more, the CPU 100 sets time data (T0) in the timer 104, and sets the time data (T1) (T1>T0) in the timer 104 when it is detected that the number of pitches (PA) is less than 13. The timer 104 generates an output signal to the CPU 100 after a period of time corresponding to the time data (T0) or (T1) thus set has elapsed. If one step movement of the carriage has already been completed, the CPU 100 supplies a drive signal to the solenoid 108 in response to the output signal from the timer 104, thereby driving the printing hammer 109 using the solenoid 108. Further, if the movement of the carriage is not yet complete, the CPU 100 does not respond to the output signal from the timer 104, and only applies a drive signal to the solenoid 108 when the movement of the carriage has been completed. Thus, the type set to the present printing position is printed on the sheet 4. After this printing has finished, the CPU 100 stands ready for the next keying operation in STEP 1.

If it is detected in STEP 2 that the operated key is not a character key, but is a function key, the CPU 100 checks whether or not the keying operation requires the movement of the carriage as in STEP 4. When it is detected that the operated function key is any one of the keys for moving the carriage such as the space key, the shift key and the carriage return key, the carriage is moved in response to this requirement, and the CPU 100 stands by for the next key input in STEP 1.

When it is detected in STEP 4 that the operated function key is the paper feed key or the margin set key, the CPU 100 stands by the next keying operation in STEP 1 after the required operation has been executed.

In the embodiment as described above, if the daisy printing wheel 12 is rotated by 0 to 12 pitches for printing, the printing hammer 14 is driven when a period of time T1, e.g., 15 msec. has elapsed, thereby executing the printing process. Further, in the case where the printing wheel 12 is rotated by 13 to 50 pitches, the printing hammer 14 is driven when a period of time T0, e.g., 9 msec. has elapsed, thereby executing the printing process. Therefore, since the printing hammer 14 is driven after a suitably short standby time which begins when the printing wheel 12 is rotated through 13 to 50 pitches and since the vibration of the supporting plates 12-1 and the type 12-2 is attenuated to have a sufficiently small value, the average printing speed can be enhanced.

Figure 8:
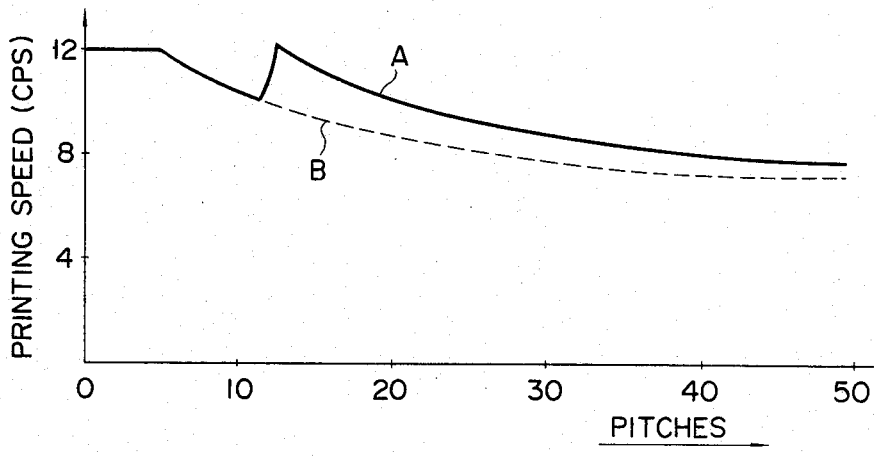
FIG. 8 is printing speed characteristic diagram showing the printing speed characteristics of the present invention and of the prior printing device.

FIG. 8 shows the printing speed characteristics by a solid line A in a case where the standby time, when the daisy printing wheel is rotated through 0 to 12 pitches, is set to T1, and the standby time, when the printing wheel is rotated through 13 to 50 pitches, is set to T0. A broken line B in FIG. 8 shows the case where the standby time, when the printing wheel is rotated through 0 to 50 pitches, is set to T1. Incidentally, the maximum printing speed in this embodiment is limited by the speed of the stepping drive of the carriage, and is set to be 12 characters per second.

As apparent from FIG. 8, when the daisy printing wheel 12 is rotated through 13 pitches, the printing speed becomes 10 cps at the curve of the broken line B, while the printing speed becomes 12 cps at the curve of the solid line A. This difference is caused by the difference between the standby times T1 and T0 set respectively by the revolution of 13 pitches of the printing wheel. As the number of pitches to be rotated increases, the difference of the standby times T1 and T0 becomes relatively smaller as compared to the time required for the revolution of the printing wheel. Therefore, the difference of the printing speeds shown by the solid line A and the broken line B decreases.

The present invention has been described with reference to one embodiment. However, the present invention is not limited to the particular embodiment described above. Various other changes and modifications may be made within the spirit and scope of the present invention. For example, in the flow chart in FIG. 7, the printing hammer 14 may be driven by energizing the solenoid 108 without setting the time data in the timer 104 when the number of pitches (PA) is 0 by first checking whether or not the number of pitches (PA) is 0 before checking whether or not the number of pitches (PA) is less than 13 as in STEP 3.

In the embodiments described above, the standby times T0 and T1 are selectively set. However, the average printing speed may be further improved by selectively setting the timer 104 for the standby times in response to the number of pitches to be rotated and by employing more standby times of different lengths.

Further, in the embodiment described above, the printing device associated with the electronic typewriter has been described. However, the printing device of the present invention may also be used, for example, as a printer for a computer.

In addition, it is possible to move the carriage by one step immediately after each printing operation. In this case, the CPU 100 may always supply a drive signal to the solenoid 108 in response to the output signal from the timer 104.

What is claimed is:

1. A daisy wheel type printing device comprising:

a daisy wheel having a plurality of type holding members including type at the respective ends thereof;

means for determining the amount of daisy wheel rotation required to set the type designated by input character data to a printing position;

wheel driving means coupled to the determining means for rotating the daisy wheel such that when the rotation is for a Preset amount or less the daisy wheel is accelerated and immediately decelerated, whereas when the rotation is for more than said preset amount the daisy wheel is accelerated, then rotated at a contant speed, and finally decelerated;

a printing hammer including means for hitting the type set to the printing position;

timer means coupled to said determining means, said timer means including means responsive to arrival of the type designated by the input character data at the printing position for establishing a delay period starting at the time of such arrival and having a first duration when the daisy wheel is rotated by said preset amount or less, and a second duration which is shorter than said first duration when the daisy wheel is rotated by more than said preset amount; and control means for driving the printing hammer when said delay period elapsed.

2. The daisy wheel type printing device according to claim 1, wherein said determining means comprises a first memory means for storing position data representing the position of the type disposed at the printing position, and a data processing means for applying a drive command signal to the wheel driving means to rotate the daisy wheel by the rotation amount in accordance with the difference between position data representing the position of the type designated by an input character data and position data stored in the first memory.

3. The daisy wheel type printing device according to claim 2, wherein said daisy printing wheel has a through hole, and further comprising home position detector means for detecting the through hole to supply an output signal to said determining means.

4. The daisy wheel type printing device according to claim 8, wherein said daisy printing wheel has a through hole, and further comprising home position detector means for detecting the through hole to supply an output signal to said determining means.

5. The daisy wheel type printing wheel according to claim 1, wherein said wheel driving means accelerates said daisy wheel to a maximum speed when said rotation is for more than said preset amount, and said constant speed is the maximum speed.

6. The daisy wheel type printing device according to claim 1, wherein daisy printing wheel has a through hole, and further comprising home position detector means for detecting the through hole to supply an output signal to said determining means.

* * * * *